US006510896B2

(12) United States Patent
Bode et al.

(10) Patent No.: US 6,510,896 B2
(45) Date of Patent: Jan. 28, 2003

(54) APPARATUS AND METHODS FOR UTILIZING EXPANDABLE SAND SCREEN IN WELLBORES

(75) Inventors: Jeffrey Bode, The Woodlands, TX (US); Craig Fishbeck, Houston, TX (US); Bill Rouse, Houston, TX (US); Ronnie S. Royer, Lafayette, LA (US)

(73) Assignee: Weatherford/Lamb, Inc., Houston, TX (US)

( * ) Notice: Subject to any disclaimer, the term of this patent is extended or adjusted under 35 U.S.C. 154(b) by 41 days.

(21) Appl. No.: 09/849,624

(22) Filed: May 4, 2001

(65) Prior Publication Data

US 2002/0162664 A1 Nov. 7, 2002

(51) Int. Cl.[7] ..... E21B 43/02

(52) U.S. Cl. ..... 166/276; 166/278; 166/387; 166/51; 166/205; 166/229

(58) Field of Search ..... 166/244.1, 265, 166/276, 278, 381, 385, 387, 51, 205, 227, 229

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | 153/81 |
| 1,981,525 | A | 11/1934 | Price | 166/4 |
| 2,383,214 | A | 8/1945 | Prout | 153/82 |
| 2,499,630 | A | 3/1950 | Clark | 153/81 |
| 2,627,891 | A | 2/1953 | Clark | 153/82 |
| 2,663,073 | A | 12/1953 | Bieber et al. | 29/148 |
| 2,754,577 | A | 7/1956 | Maxwell | 29/523 |
| 2,898,971 | A | 8/1959 | Hempel | 153/82 |
| 3,087,546 | A | 4/1963 | Wooley | 166/46 |
| 3,195,646 | A | 7/1965 | Brown | 166/208 |
| 3,467,180 | A | 9/1969 | Pensotti | 165/180 |
| 3,818,734 | A | 6/1974 | Bateman | 72/75 |
| 3,911,707 | A | 10/1975 | Minakov et al. | 72/76 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,324,407 | A | 4/1982 | Upham et al. | 277/27 |
| 4,371,199 | A | 2/1983 | Kushner et al. | 285/382.2 |

(List continued on next page.)

FOREIGN PATENT DOCUMENTS

| | | | |
|---|---|---|---|
| EP | 0 961 007 | 12/1999 | E21B/33/10 |

(List continued on next page.)

OTHER PUBLICATIONS

Weatherford Completion Systems, "Expandable Sand Screen," ESS Technical Update, Weatherford International, Inc., Brochure No. 160.00, Copyright 2000.

(List continued on next page.)

*Primary Examiner*—Roger Schoeppel
(74) *Attorney, Agent, or Firm*—Moser, Patterson & Sheridan, L.L.P.

(57) ABSTRACT

In one aspect of the invention apparatus and methods are provided for completing a wellbore using expandable sand screen. An apparatus including a section of expandable sand screen, and an expanding member is disposed in the wellbore on a tubular run-in string. Thereafter, the expandable sand screen is expanded in a producing area of the wellbore.

16 Claims, 9 Drawing Sheets

U.S. PATENT DOCUMENTS

| | | | | |
|---|---|---|---|---|
| 4,429,620 | A | 2/1984 | Burkhardt et al. | 91/395 |
| 4,502,308 | A | 3/1985 | Kelly | 72/58 |
| 4,531,581 | A | 7/1985 | Pringle et al. | 166/120 |
| 4,588,030 | A | 5/1986 | Blizzard | 166/120 |
| 4,697,640 | A | 10/1987 | Szarka | 166/120 |
| 4,848,469 | A | 7/1989 | Baugh et al. | 166/382 |
| 5,271,472 | A | 12/1993 | Leturno | 175/107 |
| 5,322,127 | A | 6/1994 | McNair et al. | 166/313 |
| 5,366,012 | A | 11/1994 | Lohbeck | 166/277 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,560,426 | A | 10/1996 | Trahan et al. | 166/120 |
| 5,685,369 | A | 11/1997 | Ellis et al. | 166/195 |
| 5,901,787 | A | 5/1999 | Boyle | 166/135 |
| 5,901,789 | A | 5/1999 | Donnelly et al. | 166/381 |
| 6,021,850 | A | 2/2000 | Wood et al. | 166/380 |
| 6,062,307 | A | 5/2000 | Hamid et al. | 166/51 |
| 6,098,713 | A | 8/2000 | Ross | 166/297 |
| 6,098,717 | A | 8/2000 | Bailey et al. | 166/382 |
| 6,263,966 | B1 | 7/2001 | Haut et al. | 166/278 |
| 6,263,972 | B1 * | 7/2001 | Richard et al. | |
| 6,325,148 | B1 | 12/2001 | Trahan | |
| 6,412,565 | B1 * | 7/2002 | Castano-Mears | |
| 6,415,509 | B1 * | 7/2002 | Echols et al. | |
| 6,425,444 | B1 | 7/2002 | Metcalfe et al. | |
| 6,431,271 | B1 * | 8/2002 | Thomeer et al. | |
| 6,446,323 | B1 | 9/2002 | Metcalfe et al. | |

FOREIGN PATENT DOCUMENTS

| | | | |
|---|---|---|---|
| GB | 1 448 304 | 9/1976 | E21B/33/13 |
| GB | 1 457 843 | 12/1976 | B21D/39/10 |
| GB | 2 216 926 | 10/1989 | E21B/7/20 |
| GB | 2 313 860 | 12/1997 | E21B/10/34 |
| GB | 2 320 734 | 7/1998 | E21B/33/127 |
| GB | 2 329 918 | 4/1999 | E21B/43/10 |
| GB | 2 344 606 | 6/2000 | E21B/33/14 |
| WO | WO 93/24728 | 12/1993 | E21B/17/10 |
| WO | WO 97/17526 | 5/1997 | E21B/43/10 |
| WO | WO 99/18328 | 4/1999 | E21B/23/01 |
| WO | WO 99/23354 | 5/1999 | E21B/43/10 |
| WO | WO 00/26500 | 5/2000 | E21B/19/22 |
| WO | WO 01/04535 | 1/2001 | F16L/55/16 |

OTHER PUBLICATIONS

PCT International Search Report from PCT/GB99/04225, Dated Jun. 28, 2000.

U.S. patent application Ser. No. 09/469,690, Simpson, filed Dec. 22, 1999.

U.S. patent application Ser. No. 09/469,643, Metcalfe et al., filed Dec. 22, 1999.

U.S. patent application Ser. No. 09/469,526, Metcalfe et al., filed Dec. 22, 1999.

U.S. patent application Ser. No. 09/469,681, Metcalfe et al., filed Dec. 22, 1999.

PCT International Search Report from International Application No. PCT/GB02/02005, dated Jul. 25, 2002.

* cited by examiner

APPARATUS AND METHODS FOR UTILIZING EXPANDABLE SAND SCREEN IN WELLBORES

BACKGROUND OF THE INVENTION

1. Field of the Invention

The present invention relates to well completion; more particularly the present invention relates to methods and apparatus involving the use of expandable tubulars in a wellbore; still more particularly the invention includes trip saving methods and apparatus for use with expandable sand screen.

2. Background of the Related Art

The completion of wells includes the formation of a borehole to access areas of the earth adjacent underground formations. Thereafter, the borehole may be lined with steel pipe to form a wellbore and to facilitate the isolation of a portion of the wellbore with packers. The casing is perforated adjacent the area of the formation to be accessed to permit production fluids to enter the wellbore for recovery at the surface of the well. Whether the well is drilled to produce hydrocarbons, water, geothermal energy, or is intended as a conduit to stimulate other wells, the basic construction is the same. In addition to creating and perforating a wellbore, the formation surrounding a wellbore may be treated to enhance production of the well. For example, when a formation having very low permeability, but a sufficient quantity of valuable fluids is to be produced, it is necessary to artificially increase the formation's permeability. This is typically accomplished by "fracturing" the formation, a practice which is well known in the art and for which purpose many methods have been conceived. Basically, fracturing is achieved by applying sufficient pressure to the formation to cause it to crack or fracture, hence the term "fracturing" or simply "fracing". The desired result of this process is that the cracks interconnect the formation's pores and allow the valuable fluids to be brought out of the formation and to the surface.

The general sequence of steps needed to stimulate a production zone through which a wellbore extends is as follows: First, a performable nipple is made up in the well casing and cemented in at a predetermined depth in the well within the subterranean production zone requiring stimulation. Next a perforating trip is made by lowering a perforation assembly into the nipple on a tubular work-string. The perforating assembly is then detonated to create a spaced series of perforations extending outwardly through the nipple, the cement and into the production zone. The discharged gun assembly is then pulled up with the workstring to complete the perforating trip. Thereafter, stimulating and fracturing materials are injected into the well.

Another frequently used technique to complete a well is the placement of sized gravel in an annular area formed between the perforated casing and a screen member disposed on the end of tubing that is coaxially inserted into the wellbore as a conduit for production fluids. In order to eliminate or reduce the production of formation sand, a sand screen is typically placed adjacent to the perforations or adjacent to an open wellbore face through which fluids are produced. A packer is usually set above the sand screen and the annulus around the screen is then packed with a relatively course sand, commonly referred to as gravel, to form a gravel pack around the sand screen as well as in the perforations and/or in the producing formation adjacent the well bore for filtering sand out of the in-flowing formation fluids. In open hole gravel pack installations, the gravel pack also supports the surrounding unconsolidated formation and helps to prevent the migration of sand with produced formation fluids.

Recently, technology has arisen making it possible to expand a tubular in a wellbore. These in-situ expansion apparatus and methods permit a tubular of a smaller diameter to be inserted into a wellbore and then expanded to a larger diameter once in place. The advantages of time and space are obvious. The technique has also be applied to sand screens, or those tubulars members at the lower end of production tubing designed to permit the passage of production fluid therethrough but to inhibit the passage of particulate matter, like sand. An expandable slotted tubular usable as a sand screen and a method for its use is described in published Application No. PCT/GB98/03261 assigned to the same entity as the present application, and that publication is incorporated herein by reference in its entirety.

An expandable sand screen is typically inserted into a wellbore on the end of a run-in string of tubulars with its initial outer diameter about the same as the diameter of the run-in string. In one method of in-situ expansion, a wedge-shaped cone member is also run into the well at an upper or lower end of the expandable screen with the tapered surface of the cone decreasing in diameter in the direction of the expandable screen. The cone typically is mounted on a separate string to permit it to move axially in the wellbore independent of the expandable screen. At a predetermined time, when the screen is fixed in the wellbore adjacent that portion where production fluid will enter the perforated casing, the cone is urged through the expandable screen increasing its inner and outer diameters to the greatest diameter of the cone. Due to physical forces and properties, the resulting expanding screen is actually larger in inside diameter thus the outside diameter of the core.

In one technique, the cone is pulled up through the screen and then removed from the well with the run-in string. In another technique, the cone is used in a top-down fashion and is either dropped to the bottom of the well or is left at the bottom end of the well screen where it does not interfere with fluid production through the expanded well screen thereabove. In another method of expansion, an expansion tool is run into the wellbore on a string of tubulars to a location within the tubular to be expanded. The expansion tool includes radially expandable roller members which can be actuated against the wall of a tubular via fluid pressure. In this manner, the wall of the tubular can be expanded past its elastic limits and the inner and outer diameter of the tubular is increased. The expansion of the tubular in the case of expandable well screen is facilitated by slots formed in the wall thereof.

An expander tool usable to expand solid or slotted tubulars is illustrated in FIGS. 1–3. The expansion tool 100 has a body 102 which is hollow and generally tubular with connectors 104 and 106 for connection to other components (not shown) of a downhole assembly. FIGS. 1 and 2 are perspective side views of the expansion tool and FIG. 3 is an exploded view thereof. The end connectors 104 and 106 are of a reduced diameter (compared to the outside diameter of the longitudinally central body part 108 of the tool 100), and together with three longitudinal flutes 110 on the central body part 108, allow the passage of fluids between the outside of the tool 100 and the interior of a tubular therearound (not shown). The central body part 108 has three lands 112 defined between the three flutes 110, each land 112 being formed with a respective recess 114 to hold a respective expandable member 116. Each of the recesses 114 has parallel sides and extends radially from the radially perforated tubular core 115 of the tool 100 to the exterior of the respective land 112. Each of the mutually identical rollers 116 is near-cylindrical and slightly barreled. Each of the rollers 116 is mounted by means of a bearing 118 at each end of the respective roller for rotation about a respective rotation axis which is parallel to the longitudinal axis of the tool 100 and radially offset therefrom at 120-degree mutual circumferential separations around the central body 108. The bearings 418 are formed as integral end members of radially slidable pistons 120, one piston 120 being slidably sealed within each radially extended recess 114. The inner end of each piston 120 (FIG. 2) is exposed to the pressure of fluid within the hollow core of the tool 100 by way of the radial perforations in the tubular core 115.

While expandable sand screen is useful in wells to eliminate the annular area formed between a conventional screen and a casing, its use can add yet another step to the completion of a well and requires at least an additional trip into the well with a run-in string of tubular in order to expand the screen. Because the various completion operations described are performed in separate and time consuming steps, there is a need for well completion apparatus and methods using expandable well screen that combines various completion steps and decreases time and expense associated with completing a well.

SUMMARY OF THE INVENTION

In one aspect of the invention apparatus and methods are provided for completing a wellbore using expandable sand screen. An apparatus including a section of expandable sand screen, and an expanding member is disposed in the wellbore on a tubular run-in string. Thereafter, the expandable sand screen is expanded in a producing area of the wellbore. In another aspect of the invention, the apparatus includes a packer above and below the section of expandable sand screen to isolate the wellbore above and below the sand screen. In another aspect of the invention, the apparatus includes a perforating assembly which is utilized to form perforations in a wellbore casing and thereafter, the expandable sand screen is expanded in the area of the perforations. In another aspect of the invention, wellbore casing is perforated and subsequently treated with fracturing materials before a section of sand screen is expanded in the area of the perforations. In another aspect of the invention, an annular area between the unexpanded sand screen and perforated casing is filled with a slurry of gravel. Thereafter, the expandable sand screen is expanded in the area of the perforations and the gravel is compressed between the sand screen and the perforated casing wall. In another aspect of the invention, a method is disclosed including the steps of running an apparatus into a wellbore, anchoring a section of well screen in the wellbore, perforating the wellbore, disposing the sand screen in the wellbore in the area of the perforations and expanding the sand screen in the area of the perforations.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 4D:
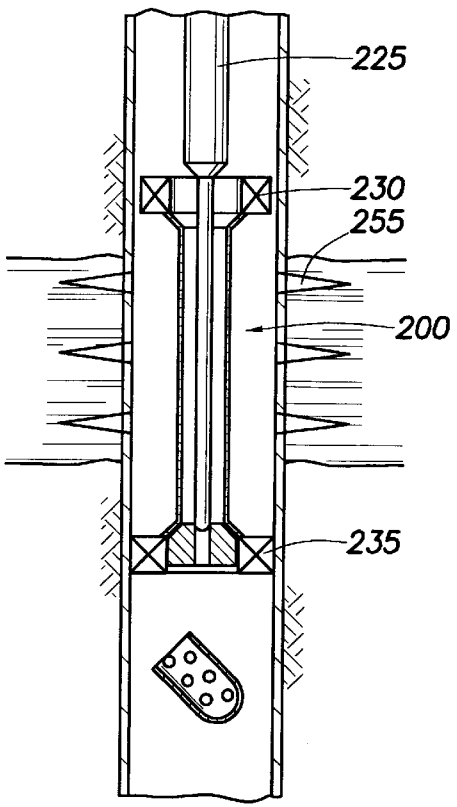
FIG. 4D illustrates the apparatus in the wellbore after the apparatus has been adjusted axially to place the perforations in the casing between the upper and lower packers of the apparatus.
Figure 4C:
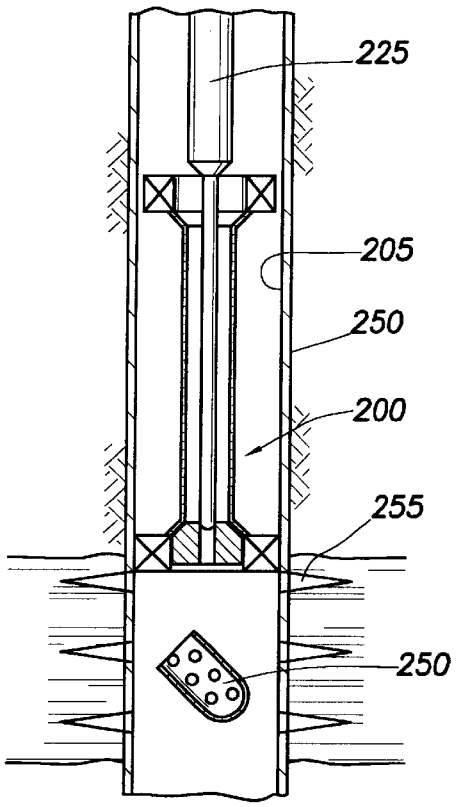
FIG. 4C is a section view of the wellbore illustrating the apparatus after perforations have been formed in wellbore casing with perforating guns.
Figure 4B:
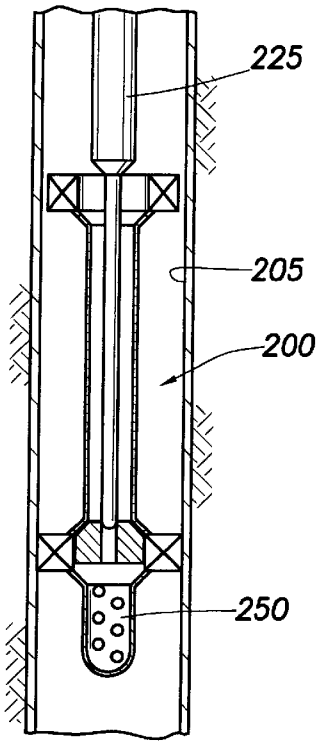
FIG. 4B is a section view of the wellbore with the lower packer of the apparatus set.
Figure 4A:
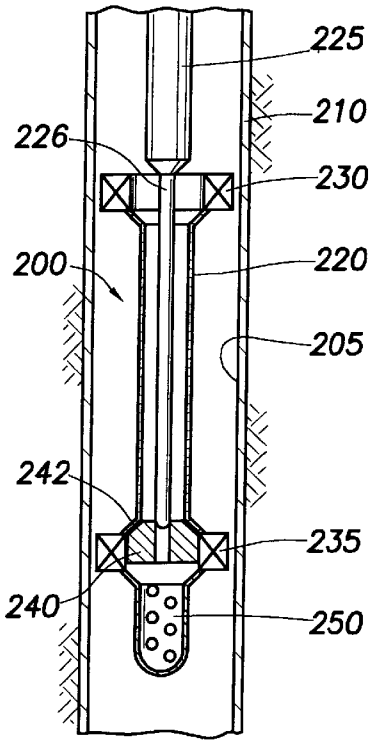
FIG. 4A is a section view of a wellbore with an apparatus of the present invention disposed therein.

FIG. 4A is a section view of a wellbore 205 with an apparatus 200 of the present invention disposed therein on a run-in string of tubulars 225 having a reduced diameter portion 226. The wellbore is typical of one drilled to access a hydrocarbon-bearing formation and the wellbore is lined with steel casing 210. While the apparatus and wellbore disclosed and illustrated are for use with hydrocarbon wells like oil and gas wells, the methods and apparatus are useful in any wellbore, even those not lined with casing. The apparatus 200 includes an expandable sand screen 220 coaxially disposed around the reduced diameter portion 226 of the run-in string. The expandable sand screen utilized in the apparatus of the invention typically includes a perforated base pipe, a filtration medium disposed around the base pipe and an expandable protective shroud, all of which are expandable. At each end of the screen 220 is packer 230, 235. A perforating gun assembly 250 is temporarily attached at a lower end of the lower packer 235 and an expansion cone 240 is temporarily attached on a lower end of the run-in string 225. The upper packer 230 is typically referred to as a production packer and includes an element to extend radially outward to contact the casing when the packer is remotely set. Packer 230 also includes a central bore to receive production string of tubulars and to seal the connection therewith. The upper packer 230 is typically set after the lower packer 235 and is set with pressure developed thereabove. The lower packer 235 is a dual grip, mechanically set packer which resists axial movement in both directions. The lower packer is typically set using rotation and weight to manipulate a slip assembly therearound.

The cone member 240 is temporarily connected at the bottom end of the run-in string 225 and includes a cone-shaped surface 242 sloped in the direction of the bottom end of the screen 220. As illustrated in FIG. 4A, the cone member rests in a central bore of the lower packer. The purpose of the cone member 240 is to expand the inner and outer diameter of the expandable screen 220 as the cone is urged through the sand screen as will be described herein. In the embodiment illustrated in FIG. 4A, the cone member is detachable from the run-in string after the expandable sand screen has been expanded. In one embodiment, a shearable connection between the cone member and the run-in string is caused to fail and the cone falls back to rest in the lower packer 235.

The perforating gun assembly 250 is typical of tubing conveyed perforating assemblies that include shaped charges designed to penetrate steel casing and provide a fluid path between the formation and the wellbore. The assembly 250 includes a tubing release member (not shown) disposed between the gun and the run-in string. The operation of perforating gun assembly 250 is well known in the art and the assembly can be fired remotely either by electrical or physical methods. The tubing release is constructed and arranged to detach the perforating gun assembly from the run-in string as the gun fires and perforates the casing therearound. The gun assembly dislocates itself from the apparatus in order to avoid any interference with other components or any other perforated zones in the well.

FIGS. 4B–4H illustrate various steps involved in utilizing the apparatus 200 of the present invention in order to complete a well. FIG. 1B is a section view of the apparatus illustrating the lower packer 230 in a set position whereby axial movement of the apparatus 200 within the wellbore 205 is restricted. The lower packer 235 is mechanically set, typically by rotating the runin string 225 and the apparatus 200 within the wellbore. In addition to fixing the apparatus 200 in the wellbore, the packer 235 is set in order to protect the upper portion of the apparatus from the discharging perforating gun assembly 250 therebelow. FIG. 4C is a section view of the apparatus 200 in the wellbore 205 illustrating the perforating gun assembly 250 having discharged to form a plurality of perforations 255 in the steel casing 250 and the formation therearound. Also illustrated in FIG. 4C is the detachable feature of the perforating gun assembly 250 whereby, after the assembly is discharged it is also mechanically disconnected from the apparatus 200 to fall from the lower packer 235.

FIG. 4D is a section view of the apparatus 200 after the apparatus has been axially moved in the wellbore to place the newly formed perforations 255 between the upper 230 and lower 235 packers. In order to adjust the axial position of the apparatus 200, the lower packer 235 is un-set after the perforations 255 are formed and the apparatus 200 and run-in string 225 is lowered in the wellbore to center the perforations 255 between the packers 230, 235. Thereafter, the lower packer 235 is re-set to again axially fix the apparatus in the wellbore 205.

Figure 4H:
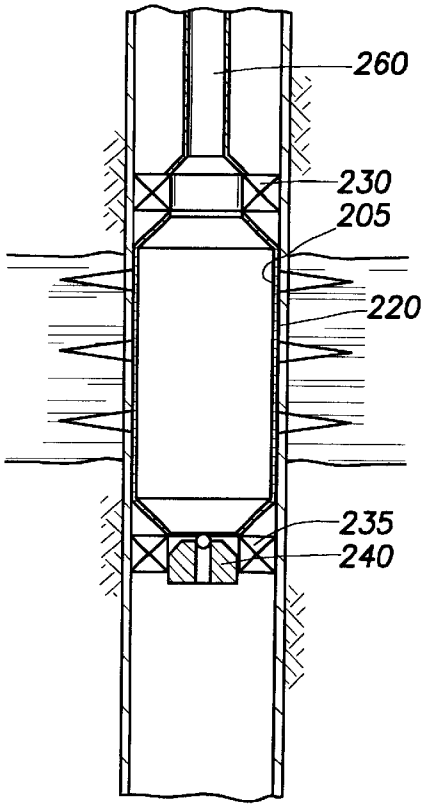
FIG. 4H illustrates the apparatus of the present invention with the expandable sand screen fully expanded, both packers set and production tubing in fluid communication with the perforated portion of the well.
Figure 4G:
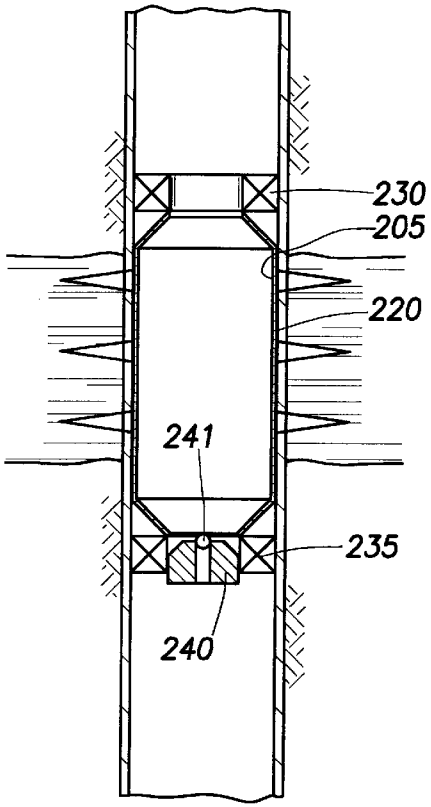
FIG. 4G illustrates the apparatus with the expanding cone having disconnected from the run-in string and retained in the lower packer.
Figure 4F:
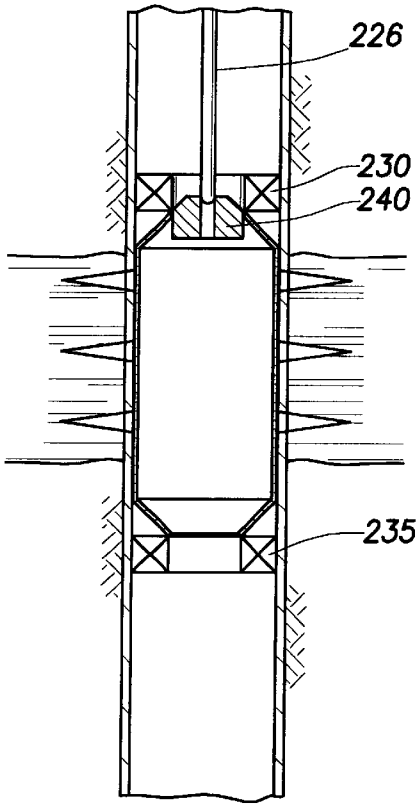
FIG. 4F illustrates the apparatus with the expandable sand screen expanded and the upper packer set.
Figure 4E:
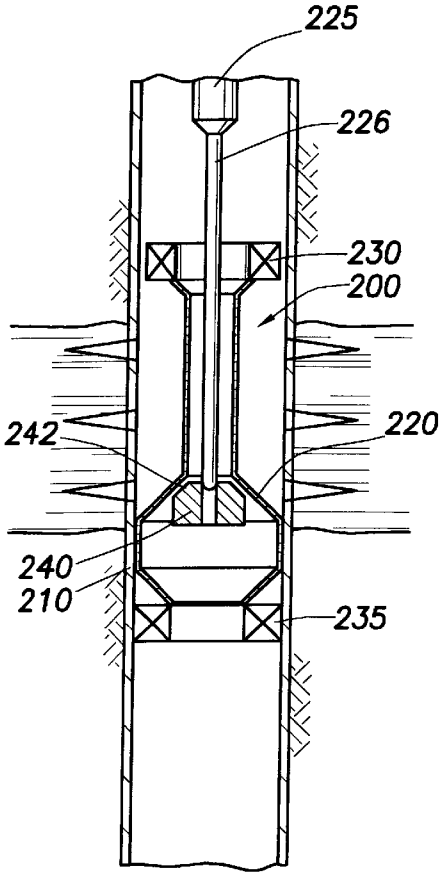
FIG. 4E illustrates an expandable sand screen portion of the apparatus being expanded by a cone member disposed at a bottom end of the run-in string.

FIG. 4E is a section view showing the apparatus 200 in the wellbore with the expandable sand screen 220 being expanded to substantially the same outer diameter as the inner diameter of the wellbore casing 210. In the embodiment shown in FIG. 1E, the run-in string 225 is pulled upwards in the wellbore and the cone member 240 is forced upward in the apparatus 200 while the expandable sand screen 220 is anchored in place by the lower packer 235 therebelow. In this manner, as the sloped surface 242 of the cone 240 moves upward through the apparatus 200, the expandable sand screen 220 is expanded. In FIG. 4E the screen is shown as expanded to an inner diameter well past the outer diameter of the cone. The Figure intentionally exaggerates the relative expansion of the screen. However, use of the screen can be expanded to substantially eliminate the annular area between the screen 220 and the casing 210.

Figure 3:
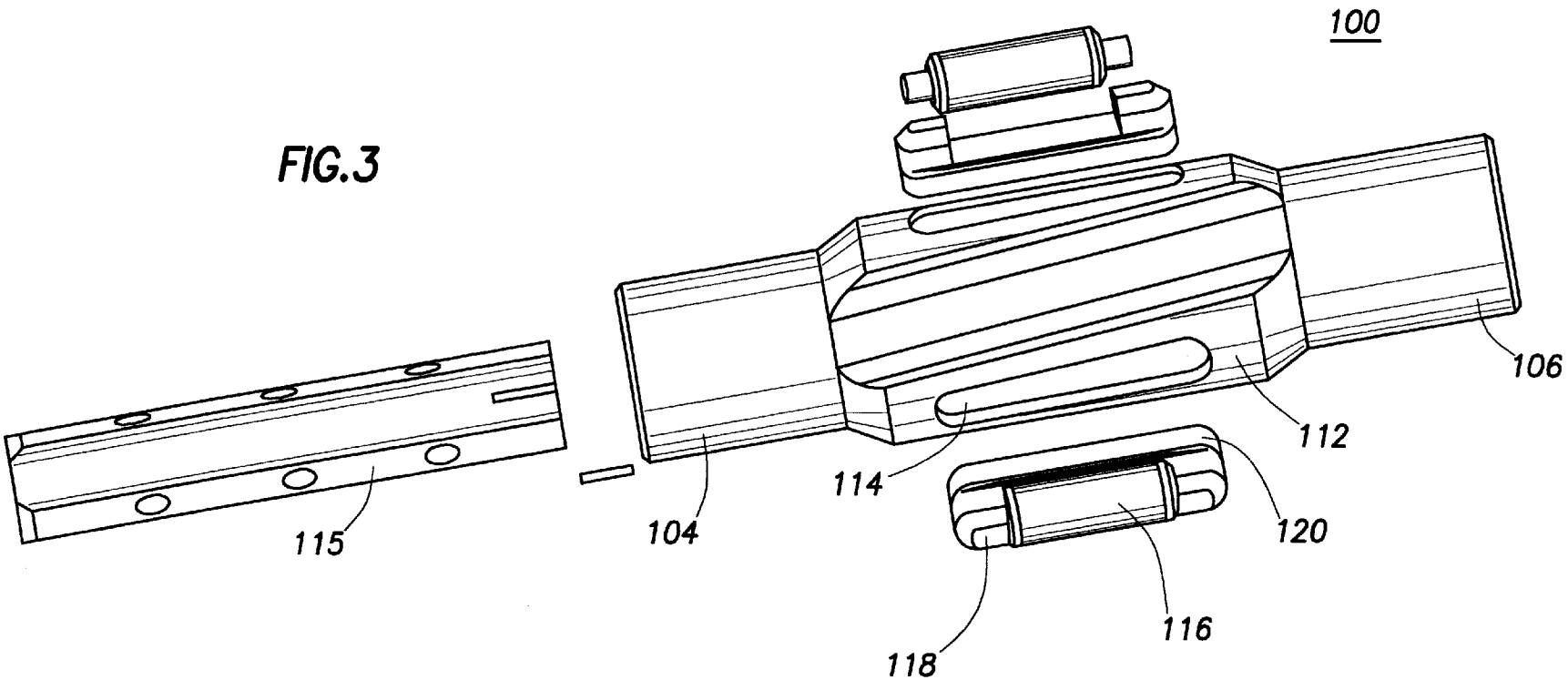
FIG. 3 is an exploded view of the expander tool.

FIG. 4F illustrates the apparatus 200 with the expandable sand screen 220 completely expanded along its length in the areas of the perforations 255, thereby eliminating any annular area formed between the sand screen 220 and the wellbore casing 210. After the expandable sand screen 220 is expanded, the upper packer 230 is hydraulically set. In one aspect, a ball 241 (visible in FIG. 4G) is dropped through the run-in string and into a receiving seat in the cone member 240 after the screen 220 is completely expanded and the cone 240 is in the position shown in FIG. 3F. Thereafter, with the fluid path through the upper packer 230 sealed, fluid pressure is increased to a predetermined level and the upper packer 230 is set. Thereafter, or simultaneously therewith, a shearing mechanism (not shown) between the cone member 240 and the run-in string 225 is caused to fail, permitting the cone member to fall down to the lower packer 235 where it is held therein. The shearing mechanism may be actuated with physical force by pulling the run-in string 225 upwards or simply by pressure. In one example, the upper packer is set with a pressure of 2,500 psi and the shearable connection between the packer and the cone fails at about 4,000 psi.

FIG. 4G is a section view of the wellbore 205 illustrating both packers 230, 235 actuated with the expandable sand screen 220 expanded therebetween and the cone member 240 located in the center of the lower packer 235. Finally, FIG. 4H illustrates another string of tubulars 260 having been attached to the upper packer 230. The string of tubulars may serve as protection tubing forming a sealed arrangement with the center of the upper packer 230.

Figure 5D:
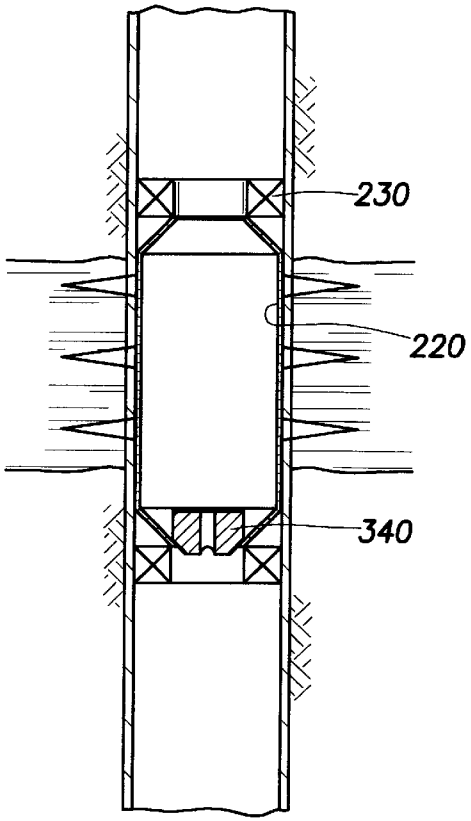
FIG. 5D is a section view of the wellbore showing a cone member 240 disposed on a lower packer.
Figure 5C:
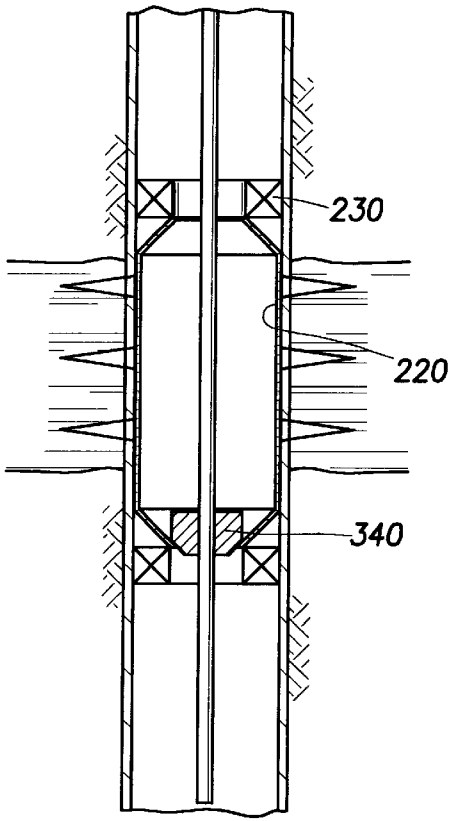
FIG. 5C is a section view of the apparatus in a wellbore with the expandable sand screen fully expanded.
Figure 5B:
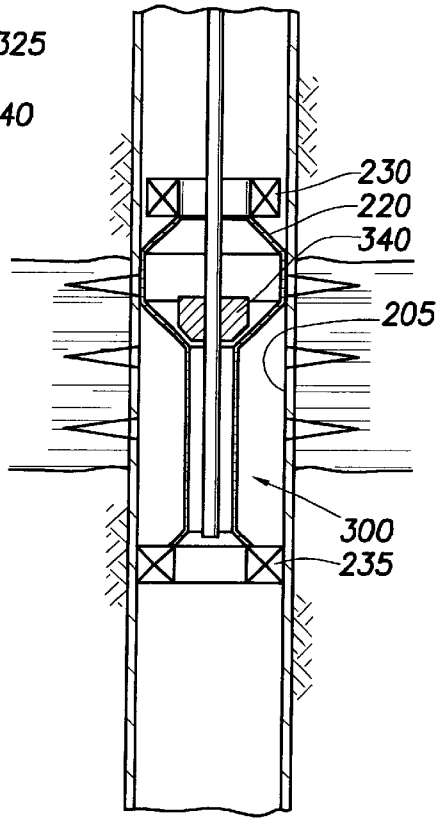
FIG. 5B is a section view of the apparatus in a wellbore with an expandable sand screen partially expanded into contact with casing therearound.
Figure 5A:
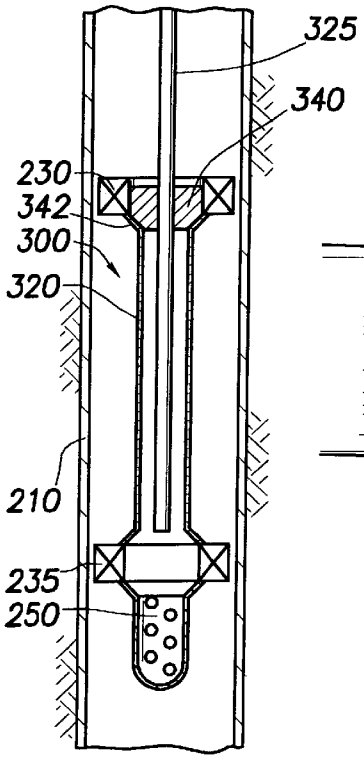
FIG. 5A is a section view of a wellbore illustrating another embodiment of the invention disposed therein.

FIG. 5A illustrates another embodiment of the invention illustrating an apparatus 300 on a string of tubulars 325. In this embodiment, a cone member 340 is disposed on the run-in string at the upper end of a section of expandable sand screen 320. A sloped surface 342 decreases the diameter of the cone member in the direction of the sand screen 320, whereby the cone 340 is arranged to expand the expandable screen 320 in a top-down fashion. As with the apparatus described in FIGS. 4A–4H, the apparatus of FIG. 5A includes an upper, hydraulically set packer 230, a lower, mechanically set packer 235 and a perforating gun assembly 250 disposed at a lower end of the lower packer 235. The lower packer 235 can be set using rotation and thereafter, the perforating gun assembly 250 can be fired by remote means, thereby forming a plurality of perforations 255 around the casing 210 and into the formation therearound. The perforation gun assembly includes a release mechanism causing the assembly to drop from the apparatus after firing. Thereafter, the lower packer 235 is un-set and the apparatus 300 is moved axially in the wellbore 205 to center the newly formed perforations 255 between the upper and lower packers 230, 235. FIG. 5B illustrates the apparatus 300 in the wellbore 205 and specifically illustrates the expandable sand screen 220 partially expanded by the downward movement of the cone member 340 along the screen which is fixed in place by the bi-directional lower packer 235 which has been re-set. In this instance, as illustrated in FIG. 5C, the cone member 340 moves downward to completely expand the sand screen 220 in the area of the perforations 250 and thereafter, the cone member 240, as illustrated in FIG. 5D latches into the lower packer 235. After the screen is expanded, upper packer 230 is set hydraulically, typically with a source of fluid from the run-in string 225 which is placed in communication with the packer by the use of some selectively operable valving arrangement between the string and the packer. Thereafter, the run-in string may be removed by shearing the cone 340 from the string 225 and a string of production tubing (not shown) can be attached to the upper packer 230 and the well can be completed for production.

Figure 1:
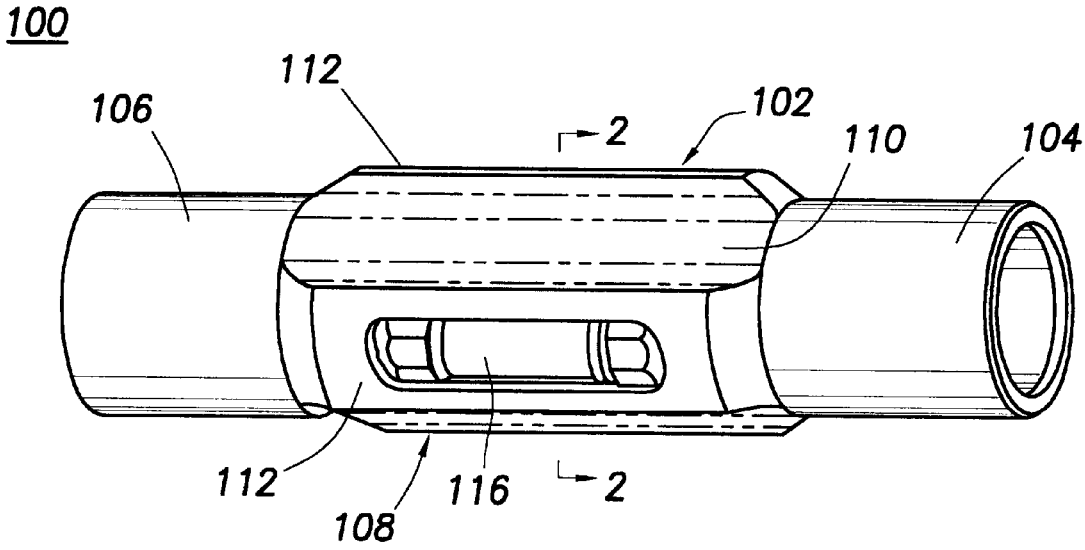
FIG. 1 is a perspective view of an expander tool.
Figure 2:
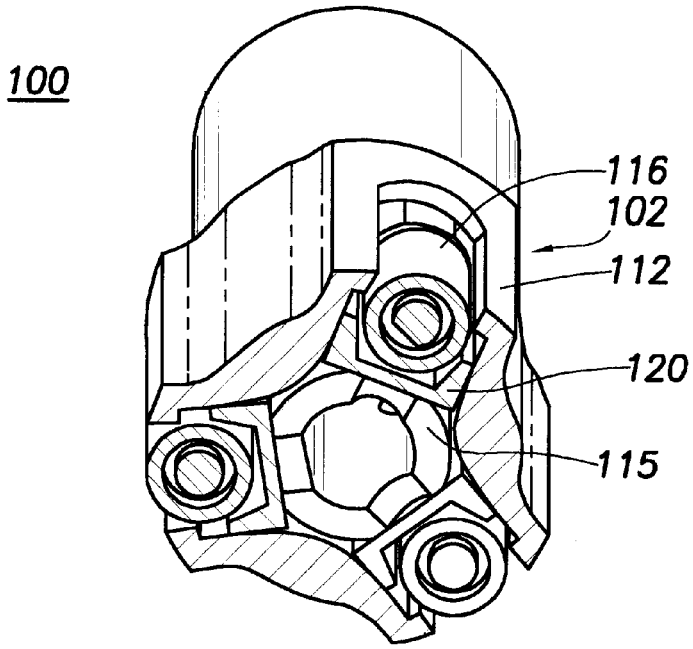
FIG. 2 is a perspective view of an expander tool.
Figure 6D:
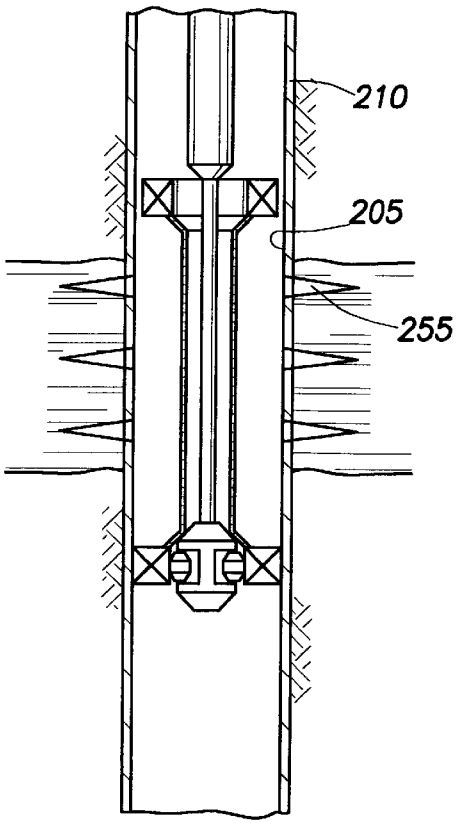
FIGS. 6A–6H are section views of another embodiment of the invention disposed in a wellbore utilizing an expander tool to expand the diameter of a section of expandable sand screen.
Figure 6C:
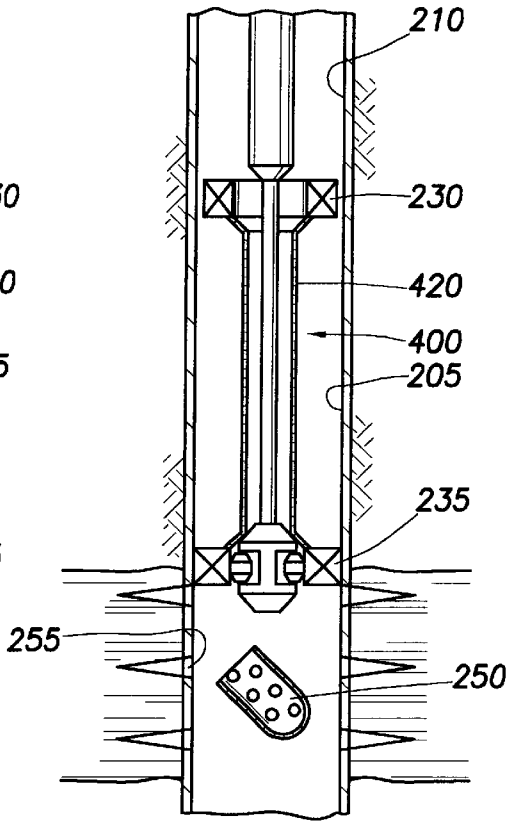
Figure 6B:
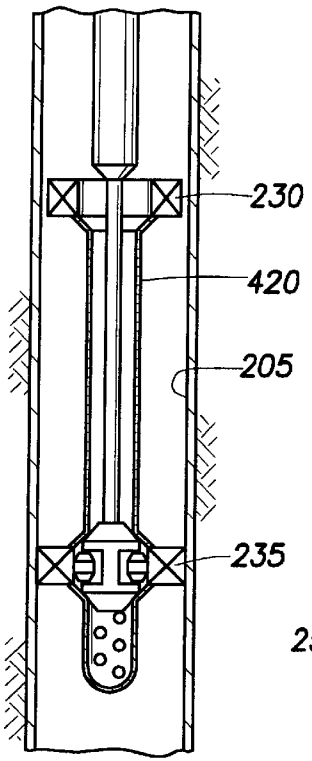
Figure 6A:
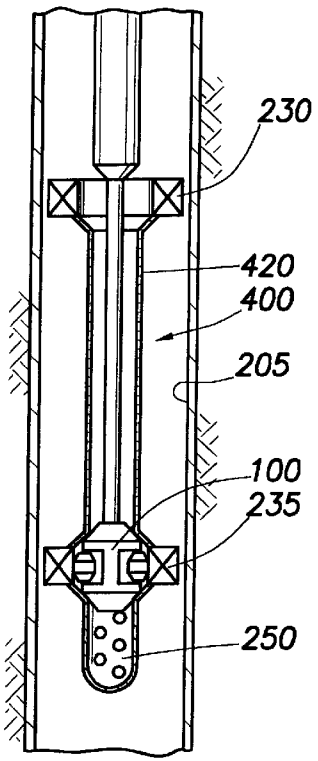

FIG. 6A is a section view illustrating another embodiment of the invention whereby an apparatus 400 includes the expander tool 100 as illustrated in FIGS. 1–3. As with foregoing embodiments, the apparatus 400 includes upper 230 and lower 235 packers with a section of expandable sand screen 420 disposed therebetween. The expander tool 100 is constructed and arranged to expand the expandable wellscreen through the use of roller members which are hydraulically actuated by fluid power provided in the tubular string 225 as discussed in connection with FIGS. 1–3. A perforating gun assembly 250 is temporarily connected at a lower end of the bottom packer 235. FIG. 6B illustrates the apparatus 400 with the lower packer 235 mechanically actuated in the wellbore 205 to fix the apparatus 400 therein. FIG. 6C illustrates the apparatus 400 after the perforating gun assembly 250 has been discharged to form perforations 255 through the wellbore casing 210 and into the formation. With its discharge, the gun assembly 250 has detached from the apparatus 400 to fall to the bottom of the wellbore 205. Thereafter, the lower packer 235 is un-set and then re-set after the apparatus 400 is adjusted axially in the wellbore 210 to center the newly formed perforations 255 between the upper 230 and lower 235 packers as illustrated in FIG. 6D.

Figure 6H:
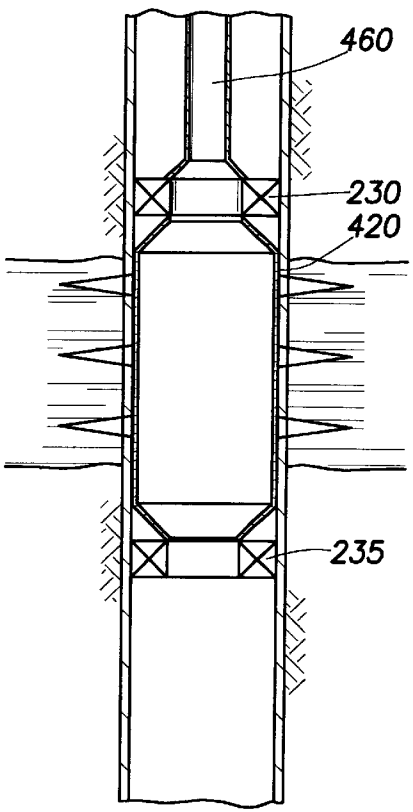
Figure 6G:
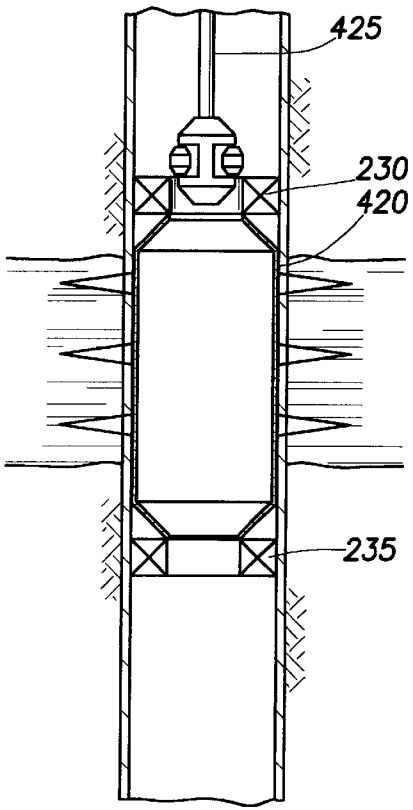
Figure 6F:
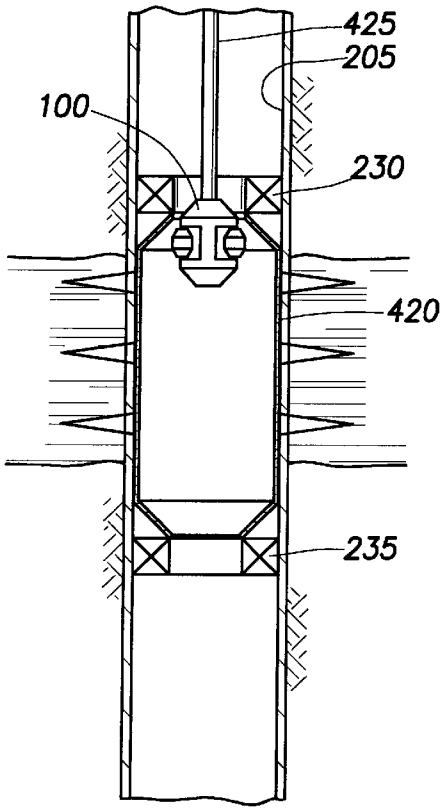
Figure 6E:
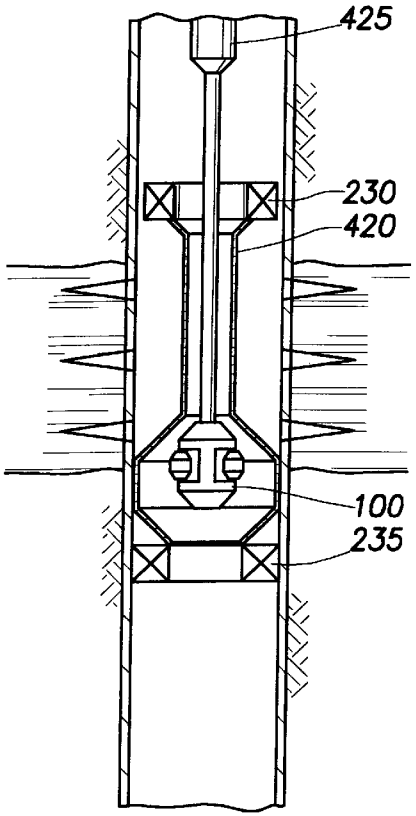

FIG. 6E shows the apparatus 400 in the wellbore after the expanding tool 100 has been actuated by fluid power and the actuated expanding tool 100 is urged upward in the wellbore 205 thereby expanding the expandable sand screen 420. Typically, the run-in string 425 bearing the expander tool 100 is pulled upwards and rotated as the rollers on the expander force the wall of the screen past its elastic limit. In this manner, substantially the entire length of the sand screen 420 can be expanded circumferentially. FIG. 6F is a section view of the wellbore 205 illustrating the sand screen 420 expanded in the area of the perforations 255 and the expanding tool 100 at the top of the sand screen 420. At this point, the expanding tool 100 is de-actuated and the hydraulically actuated rollers thereon retreat into the housing of the tool, thereby permitting the tool 100 to be removed from the wellbore through the upper packer 230 as illustrated in FIG. 6G. FIG. 6G also shows the upper packer 230 having been set hydraulically, typically by pressurized fluid in the run-in string passing into the packer 230 via a selectively operable valve member (not shown) and the alignment of apertures in the run-in string 425 and the packer 230. Finally, FIG. 6H illustrates the apparatus 400 with the run-in string 225 and expanding tool 100 having been removed and production tubing 460 attached to the upper packer 230 and creating a seal therebetween.

While FIGS. 6A–6H illustrate the apparatus 400 with the expansion tool 100 arranged to increase the diameter of the expandable sand screen 420 in a bottom-up fashion, it will be understood by those skilled in the art that the apparatus can also be used whereby the expansion tool 100 operates in a top-down fashion. Additionally, the expansion tool 100 can be run into the well on a string of coiled tubing with a mud motor disposed on the tubing adjacent the expansion tool in order to provide rotation thereto. As is well known in the art, mud motors operate with a flow of fluid and translate the flow into rotational force. Also, a fluid powered tractor can be used in the run-in string to urge the actuated expansion tool axially in the wellbore from a first to a second end of the expandable screen. Tractors, like the expansion tool 100 have a plurality of radially extendable members which can be actuated against the inner wall of a tubular around the tractor to impart axial movement to the tractor and other components mechanically attached thereto. The use of tractors is especially advantageous in a vertical with lateral wellbores. By properly sizing the body and extendable members of a tractor, the tractor can also provide axial movement in an area of a wellbore previously expanded.

Figure 7D:
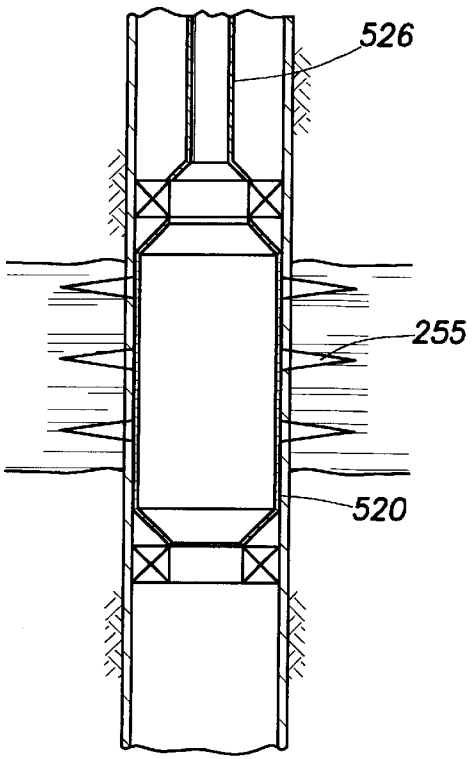
FIGS. 7A–7D illustrates another embodiment of the invention in a wellbore whereby casing is perforated and a formation therearound is treated prior to a section of expandable sand screen being expanded.
Figure 7C:
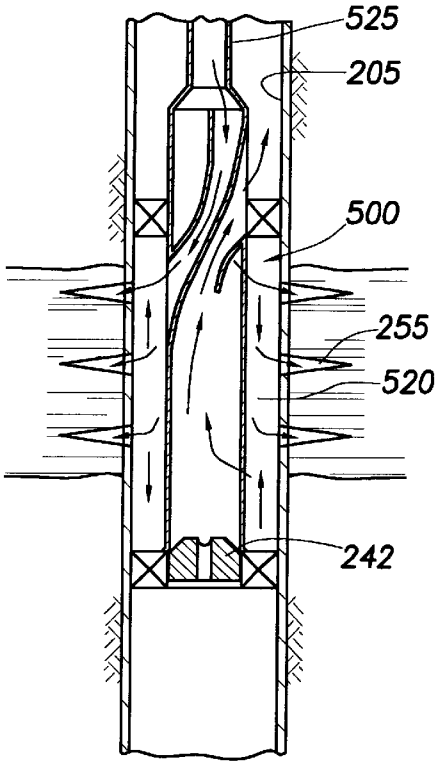
Figure 7B:
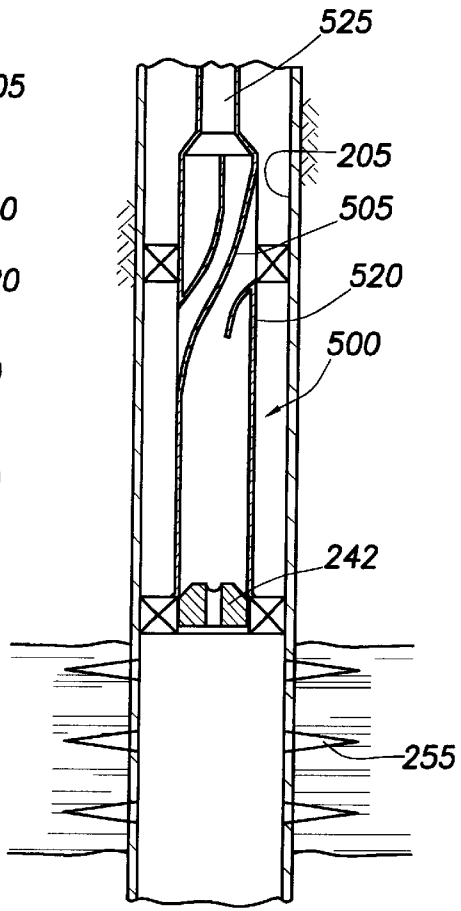
Figure 7A:
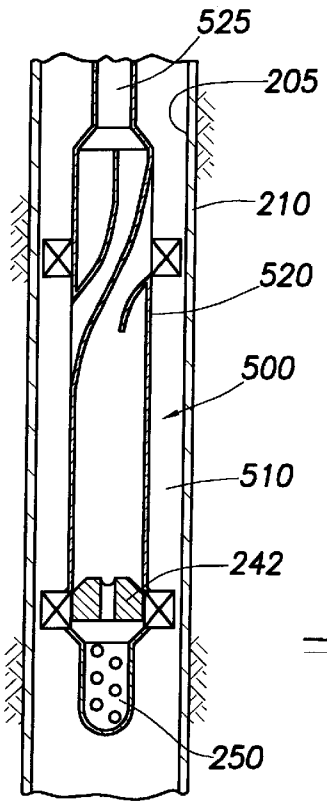

FIG. 7A illustrates another embodiment of the invention showing an apparatus 500 disposed in a cased wellbore 205. The apparatus includes a section of expandable sand screen 520, upper and lower packers 230, 235, as well as a run-in string 525 with a cone member 242 disposed at a lower end thereof and a perforating gun assembly 250 with a temporary mechanical connection disposed on the lower packer 235. Additionally, the apparatus 500 includes a cross-over tool 505 constructed and arranged to pass fluid from the inside of the tubular run-in string 525 to the annular area 510 created between the outside of the expandable sand screen 520 and the inside surface of the wellbore casing 210. The cross-over tool 505 also provides a path for circulation of fluid back to the surface of the well. The cross-over tool 505 is illustrated between the upper 230 and lower 235 packers for clarity. Typically, however, the cross-over tool is integrally formed with the upper packer 230. FIG. 7B is a section view of the apparatus 500 after the perforating gun assembly 250 has discharged and formed a plurality of perforations 255 through the wellbore casing and into the formation therearound. In FIG. 7B, the apparatus 500 has been axially re-positioned within the wellbore 205 whereby the newly formed perforations 255 are centered between the upper 230 and lower packers 235 which are set. In FIG. 7B, the perforating gun assembly 250 has fallen to the bottom of the wellbore and is not visible. FIG. 7C illustrates the apparatus 500 with arrows 501 added to depict the flow of fluid in an injection operation which is performed after the perforations 255 are formed in the casing 210. Typically, chemicals or surfactants are injected through the run-in string 525 to exit and penetrate the formation via the perforations 255 between the upper 230 and lower 235 packers. As illustrated by arrows 501, return fluid passes back up to the surface through the annular area 510 between the run-in string 525 and the casing 210 above the upper packer 230.

FIG. 7D illustrates the apparatus 500 after the cone member 242 (not shown) has been urged upward, thereby expanding the expandable sand screen 520 in the area of the perforations 255. In FIG. 7D, the cone member has been removed and the run-in string 525 has been replaced by a production string of tubulars 526 installed in a sealing relationship with an inner bore of upper packer 230. In this manner, the wellbore is perforated, treated and the expandable sand screen 520 is expanded to substantially the diameter of the casing 210 in a single trip.

Figure 8D:
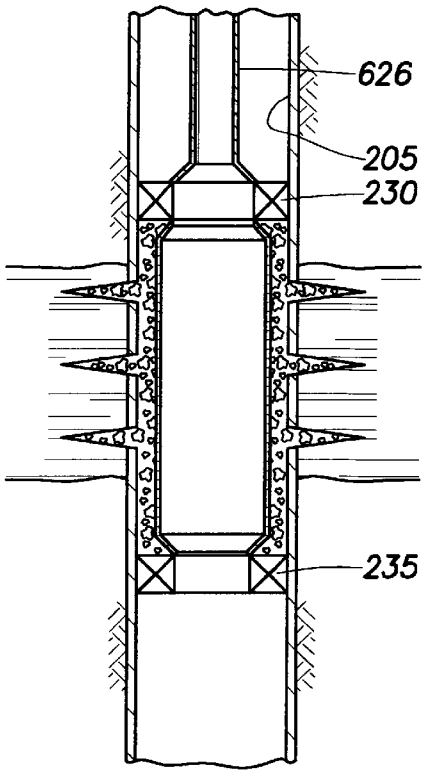
FIGS. 8A–8D illustrate another embodiment of the invention disposed in a wellbore whereby gravel is inserted in an annular area between the sand screen and the casing and then the expandable sand screen is expanded.
Figure 8C:
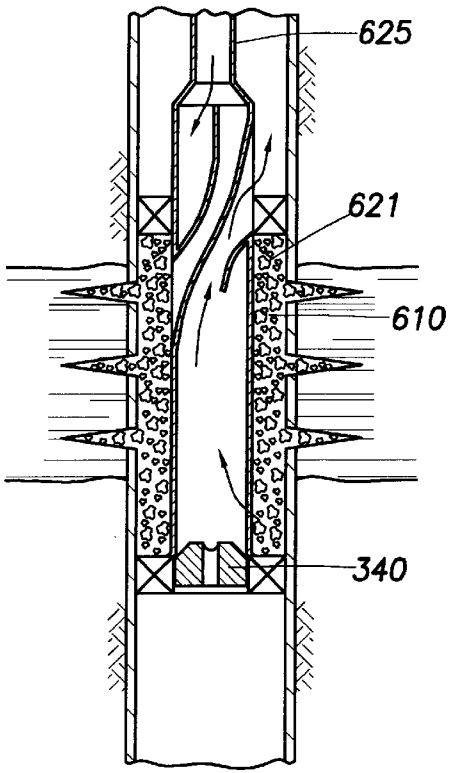
Figure 8B:
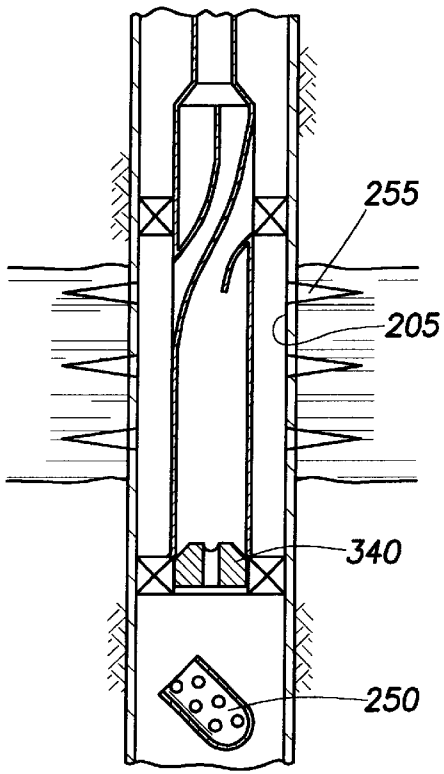
Figure 8A:
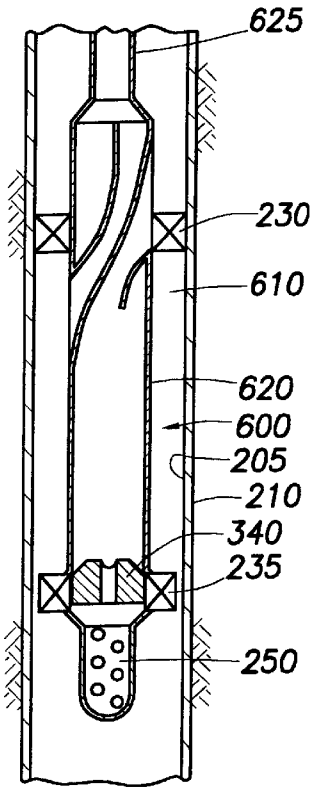

FIG. 8A illustrates another embodiment of the invention and includes a wellbore 205 having steel casing 210 therearound and an apparatus 600 disposed in the wellbore. The apparatus includes an upper 230 and lower 235 packer with a section of expandable wellscreen 620 disposed therebetween. The apparatus also includes a cone member 340 disposed at a lower end thereof and a perforating gun assembly 250 temporarily connected to a lower end of the lower packer 235. As with the apparatus 500 of FIGS. 6A–6D, the upper packer 230 also operates as a cross-over tool 605. In this embodiment, the cross-over tool is capable of passing a gravel containing slurry from the tubular run-in string 625 to an annular area 610 formed between the expandable sand screen 620 and the casing 210. FIG. 8B illustrates the apparatus 600 in the wellbore after the perforating gun assembly 250 has been discharged to form a plurality of perforations 255 in the casing 210 and the formation therearound and after the apparatus 600 has been repositioned axially in the wellbore 205 to center the newly formed perforations 255 between the upper 230 and lower 235 packers. Also in FIG. 8B, the perforating gun assembly 250 has fallen away from the apparatus 600. FIG. 8C illustrates sized gravel 621 having been disposed in the annulus 610 and in the perforations between the expandable sand screen 620 and the casing 210. This type of gravel pack is well known to those skilled in the art and the gravel is typically injected in a slurry of fluid with the fluid thereafter being removed from the gravel through a return suction created in the run-in tubular 625 or the annulus between the run-in string and the wellbore. FIG. 8D is a section view of the apparatus 600 after the cone member 340 has been urged upwards to expand the expandable sand screen 620 which is fixed in the well by the lower, mechanical packer 235. In FIG. 8D, the cone member 340 has been removed from the wellbore 205 and the run-in string 625 has been replaced by production tubing 626 which is installed in a sealing relationship with the inner bore of upper packer 230. In this manner, the expandable sand screen 620 is used in conjunction with the gravel pack to complete a well after perforations have been formed. The entire aperture is performed in a single trip into the well. The method and apparatus can also be used to first chemically treat a well and then to perform the gravel pack prior to expanding the screen section.

As the forgoing illustrates, the invention permits various wellbore activities related to the completion to be completed in a single trip.

While the foregoing is directed to the preferred embodiment of the present invention, other and further embodiments of the invention may be devised without departing from the basic scope thereof, and the scope thereof is determined by the claims that follow.

What is claimed is:

1. A method of completing a well comprising the steps of:

running an apparatus into a weilbore on a run-in string, the apparatus including a section of expandable sand screen and an expander tool axially moveable in the well, independent of the screen; and expanding the sand screen by the axial movement of the expander member to expand the screen to an outer diameter approaching the inner diameter of the wellbore therearound.

2. The method of claim 1, wherein the expandable screen is fixable in the wellbore.

3. The method of claim 1, further including the step of fixing the section of expandable screen in the wellbore prior to expanding the screen.

4. The method of claim 3, wherein the expandable screen is fixed in the wellbore with a lower packer attached to a lower end of the screen.

5. The method of claim 4, further including the step of setting the packer prior to expanding the screen.

6. The method of claim 1, wherein the expander tool includes at least one radially extendable member.

7. The method of claim 7, further including the step of energizing the expansion tool prior to expanding the sand screen.

8. The method of claim 1, further including the step of removing the string and expander tool after the screen has expanded.

9. The method of claim 1, wherein the expander tool is a generally cone-shaped member.

10. The method of claim 1, further including the step of perforating a casing around the apparatus prior to expanding the screen.

11. The method of claim 10, further including the step of moving the apparatus axially in the wellbore to locate the screen adjacent the perforations prior to expanding the screen.

12. The method of claim 10, further including the step of injecting a fluid into a formation around the wellbore after the casing is perforated.

13. The method of claim 12, wherein the fluid is a slurry containing sized gravel.

14. The method of claim 1, further including the step of setting an upper packer disposed on an upper end of the expandable screen.

15. An expandable screen assembly for use in a wellbore comprising:

a section of expandable screen fixable in the wellbore;

an upper packer disposed proximate an upper end of the screen;

a lower packer disposed proximate a lower end of the screen;

a perforating assembly disposed below the lower packer; and an expanding member disposed adjacent the lower end of the screen, the expanding member axially moveable through an inner diameter of the screen.

16. The apparatus of claim 15, wherein the expander member includes radially extendable roller members constructed and arranged to extend outwards when pressurized by fluid, to contact an inner wall of the screen and expand the diameter of the screen past its elastic limits.

* * * * *

UNITED STATES PATENT AND TRADEMARK OFFICE

CERTIFICATE OF CORRECTION

PATENT NO. : 6,510,896 B2
DATED : January 28, 2003
INVENTOR(S) : Bode et al.

It is certified that error appears in the above-identified patent and that said Letters Patent is hereby corrected as shown below:

Column 9,
Line 62, please change “weilbore” to -- wellbore --.

Signed and Sealed this

Eighth Day of July, 2003

JAMES E. ROGAN
*Director of the United States Patent and Trademark Office*